US008272090B2

(12) United States Patent
Park et al.

(10) Patent No.: US 8,272,090 B2
(45) Date of Patent: Sep. 25, 2012

(54) OPERATING METHOD FOR LAUNDRY MACHINE

(75) Inventors: Seog Kyu Park, Changwon-si (KR); Kwang Cheol Park, Busan (KR)

(73) Assignee: LG Electronics Inc., Seoul (KR)

( * ) Notice: Subject to any disclaimer, the term of this patent is extended or adjusted under 35 U.S.C. 154(b) by 778 days.

(21) Appl. No.: 11/629,132

(22) PCT Filed: Feb. 28, 2006

(86) PCT No.: PCT/KR2006/000711

§ 371 (c)(1),
(2), (4) Date: Jun. 6, 2008

(87) PCT Pub. No.: WO2007/024050

PCT Pub. Date: Mar. 1, 2007

(65) Prior Publication Data

US 2008/0256720 A1 Oct. 23, 2008

(30) Foreign Application Priority Data

Aug. 25, 2005 (KR) ..... 10-2005-0078192
Aug. 25, 2005 (KR) ..... 10-2005-0078196
Aug. 25, 2005 (KR) ..... 10-2005-0078197

(51) Int. Cl.
*D06F 25/00* (2006.01)
*D06F 35/00* (2006.01)
*D06F 39/04* (2006.01)

(52) U.S. Cl. ..... 8/149.3; 8/159

(58) Field of Classification Search ..... 8/149.1–149.3, 8/158, 159

See application file for complete search history.

(56) References Cited

U.S. PATENT DOCUMENTS

| | | | | |
|---|---|---|---|---|
| 3,762,866 | A | 10/1973 | Rayment et al. | |
| 6,032,494 | A * | 3/2000 | Tanigawa et al. | 68/12.06 |
| 6,161,306 | A * | 12/2000 | Clodic | 34/321 |
| 6,665,953 | B2 * | 12/2003 | Woo et al. | 34/527 |
| 7,325,330 | B2 * | 2/2008 | Kim et al. | 34/407 |
| 2002/0133886 | A1 | 9/2002 | Severns et al. | |
| 2004/0255391 | A1 * | 12/2004 | Kim et al. | 8/149.3 |
| 2005/0034250 | A1 * | 2/2005 | Oh et al. | 8/159 |
| 2005/0044639 | A1 * | 3/2005 | Kim et al. | 8/149.1 |
| 2005/0092035 | A1 * | 5/2005 | Shin et al. | 68/275 |
| 2005/0262644 | A1 * | 12/2005 | Oak et al. | 8/158 |
| 2006/0016020 | A1 * | 1/2006 | Park | 8/158 |

FOREIGN PATENT DOCUMENTS

| | | | |
|---|---|---|---|
| AU | 2005264689 | A1 | 1/2006 |
| CN | 1170061 | | 1/1998 |
| CN | 1580359 | | 2/2005 |
| CN | 1776074 | A | 5/2006 |
| DE | 19743508 | * | 4/1999 |
| EP | 1507028 | A1 | 2/2005 |
| EP | 1 529 875 | A2 | 5/2005 |
| GB | 255929 | A | 7/1926 |
| GB | 771492 | A | 4/1957 |
| GB | 1078422 | A | 8/1967 |

(Continued)

*Primary Examiner* — Joseph L Perrin

(74) *Attorney, Agent, or Firm* — McKenna Long & Aldridge LLP

(57) ABSTRACT

A method for operating a washing machine, in which wrinkles are removed from laundry using steam. The method includes supplying steam of a high temperature to a drum containing laundry; and supplying air to the drum. The method facilitates the refreshing of the laundry, such as clothes, thus allowing a user to wear the clothes just after the refreshing of the clothes.

17 Claims, 5 Drawing Sheets

FOREIGN PATENT DOCUMENTS

| | | | |
|---|---|---|---|
| KR | 10-2004-0015957 | | 2/2004 |
| KR | 10-2005-0045968 | | 5/2005 |
| KR | 10-2005-0047280 | | 5/2005 |
| KR | 10-2005-0074572 | | 7/2005 |
| WO | WO 2004/059070 | A1 | 7/2004 |
| WO | WO 2006/009364 | A1 | 1/2006 |

* cited by examiner

OPERATING METHOD FOR LAUNDRY MACHINE

This application claims priority to International application No. PCT/KR2006/000711 filed on Feb. 28, 2006, Korean Application No. 10-2005-0078192 filed on Aug. 25, 2005, Korean Application No. 10-2005-0078196 filed on Aug. 25, 2005, Korean Application No. 10-2005-0078197 filed on Aug. 25, 2005, all of which are incorporated by reference, as if fully set forth herein.

TECHNICAL FIELD

The present invention relates to a method for operating a washing machine, and more particularly, to a method for operating a washing machine in which wrinkles of laundry are removed using steam.

BACKGROUND ART

Generally, washing machines include a pulsator washing machine in which a drum is vertically erected, a drum washing machine in which a drum is horizontally laid, a drying and washing machine having drying and washing functions, and a drying machine having only a drying function.

Among the washing machines, the drying and washing machine and the drying machine dry laundry in a wet state by supplying air of a high temperature to the inside of a drum.

Although the laundry dried in the drying and washing machine and the drying machine has a large amount of wrinkles, the above washing machines do not have any separate structure for removing the wrinkles or do not perform any separate operation for removing the wrinkles.

Particularly, the laundry dried in the drying and washing machine and the drying machine cannot remove wrinkles from laundry in a dried state.

Thus, in order to wear clothes, which were dried by the above washing machines, a user must iron the dried clothes using an ironing machine, thereby being inconvenient.

Further, the conventional washing machines wash laundry to be deodorized using washing water and detergent, thereby causing waste of the washing water and energy and increasing damage to the laundry due to frequent washing.

DISCLOSURE OF INVENTION

An object of the present invention devised to solve the problem lies on a method for operating a washing machine, in which wrinkles are removed from laundry, such as clothes, to be smoothed, using steam.

Another object of the present invention devised to solve the problem lies on a method for operating a washing machine, in which deodorization of laundry is economically performed only if necessary.

Yet another object of the present invention devised to solve the problem lies on a method for operating a washing machine, in which laundry just after wrinkles and smells have been removed therefrom is wearable by a user.

The object of the present invention can be achieved by providing a method for operating a washing machine comprising supplying steam of a high temperature to a drum containing laundry; and supplying air to the drum. The drum is rotated during the supply of the steam.

The supply of the steam is performed until the temperature in the drum reaches a predetermined temperature. Preferably, the predetermined temperature is in the range of 40~60° C., and is determined by the amount of the laundry contained in the drum.

The supply of the steam and the supply of the air are simultaneously performed. The drum is rotated during the supply of the air. The supply of the air is performed for a predetermined time. Preferably, the predetermined time is determined by the amount of the laundry contained in the drum.

The method further comprises rotating the drum for a predetermined time after the supply of the steam is terminated and before the supply of the air is started. The method further comprises rotating the drum after the supply of the air is started.

The supply of the air comprises supplying cold air of a low temperature to the drum to remove moisture from the laundry and to cool the laundry, simultaneously. The supply of the cold air is performed until the temperature in the drum is less than a predetermined temperature. Preferably, the drum is rotated during the supply of the cold air.

The supply of the air comprises supplying hot air of a high temperature to the drum to remove moisture from the laundry. A condensing process for condensing air discharged from the drum is performing during the supply of the hot air. Preferably, a drain pump is operated during the supply of the hot air to discharge condensed water generated from the condensing process. Further, preferably, the drum is rotated during the supply of the hot air.

The supply of the air further comprises supplying cold air of a low temperature to the drum, after the supply of the hot air, to cool the laundry. The supply of the cold air is performed until the temperature in the drum is less than a predetermined temperature, or is performed for a predetermined time.

ADVANTAGEOUS EFFECTS

The method of the present invention allows the washing machine to perform a refreshing operation for removing wrinkles or smells from laundry, thereby improving consumer's satisfaction with the washing machine.

Particularly, after steam is supplied to a drum, air is supplied to the drum so that moisture, wrinkles and smells are removed from the laundry and the laundry is cooled to an initially normal temperature. Accordingly, just after the operation of the washing machine is terminated, a user can wear the laundry and feel satisfaction due to a completely dried state of the laundry.

BRIEF DESCRIPTION OF DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings.

Hereinafter, with reference to FIGS. 1 to 3, a washing machine and a method for operating the same in accordance with one preferred embodiment of the present invention are descried in detail.

Here, the washing machine of this embodiment is a drying and washing machine having drying and washing functions. However, the washing machine may be a washing machine having only a washing function, or a drying machine having only a drying function.

Figure 1:
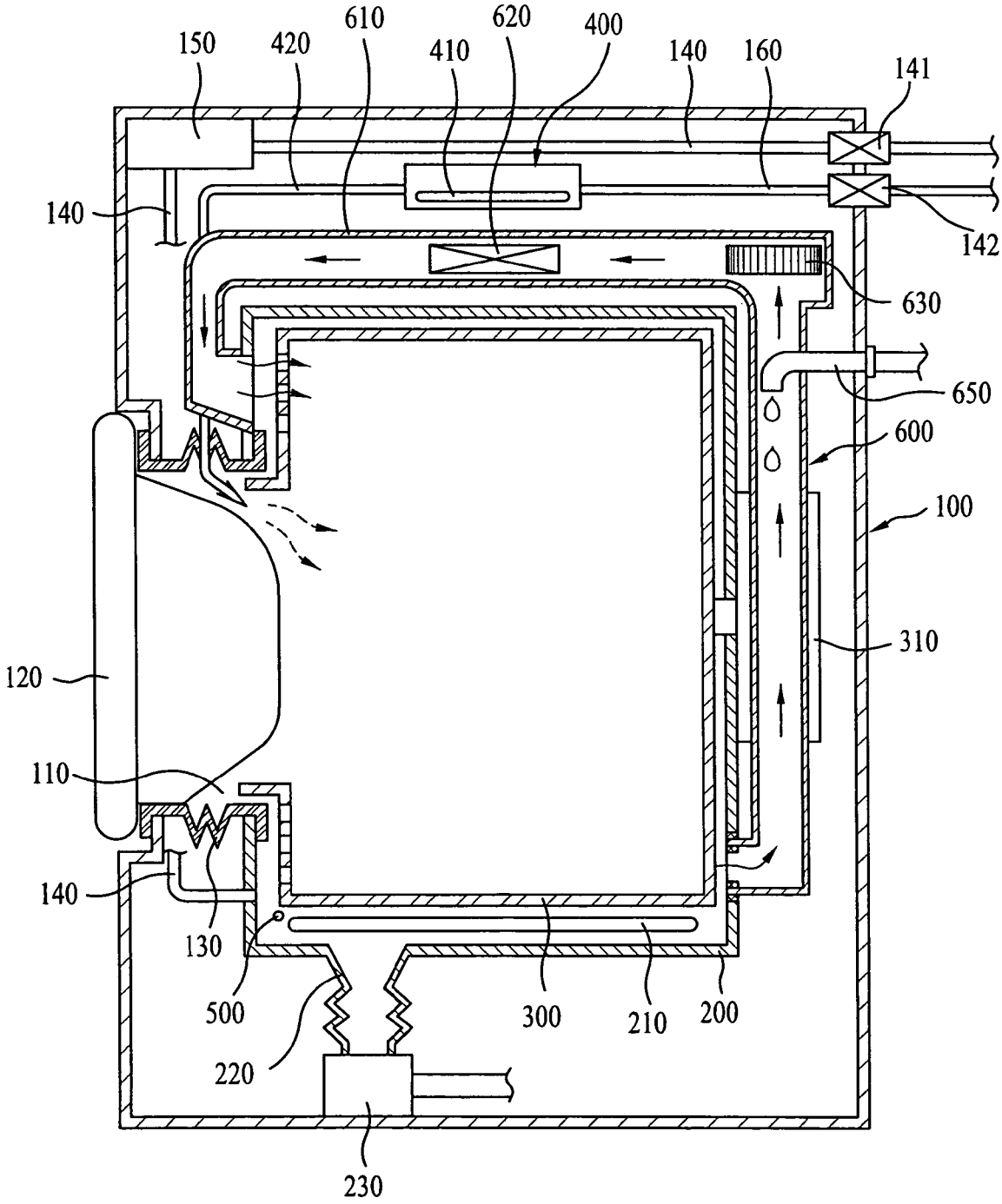
FIG. 1 is a sectional view of a washing machine employing a method for operating the washing machine in accordance with the present invention.
Figure 2:
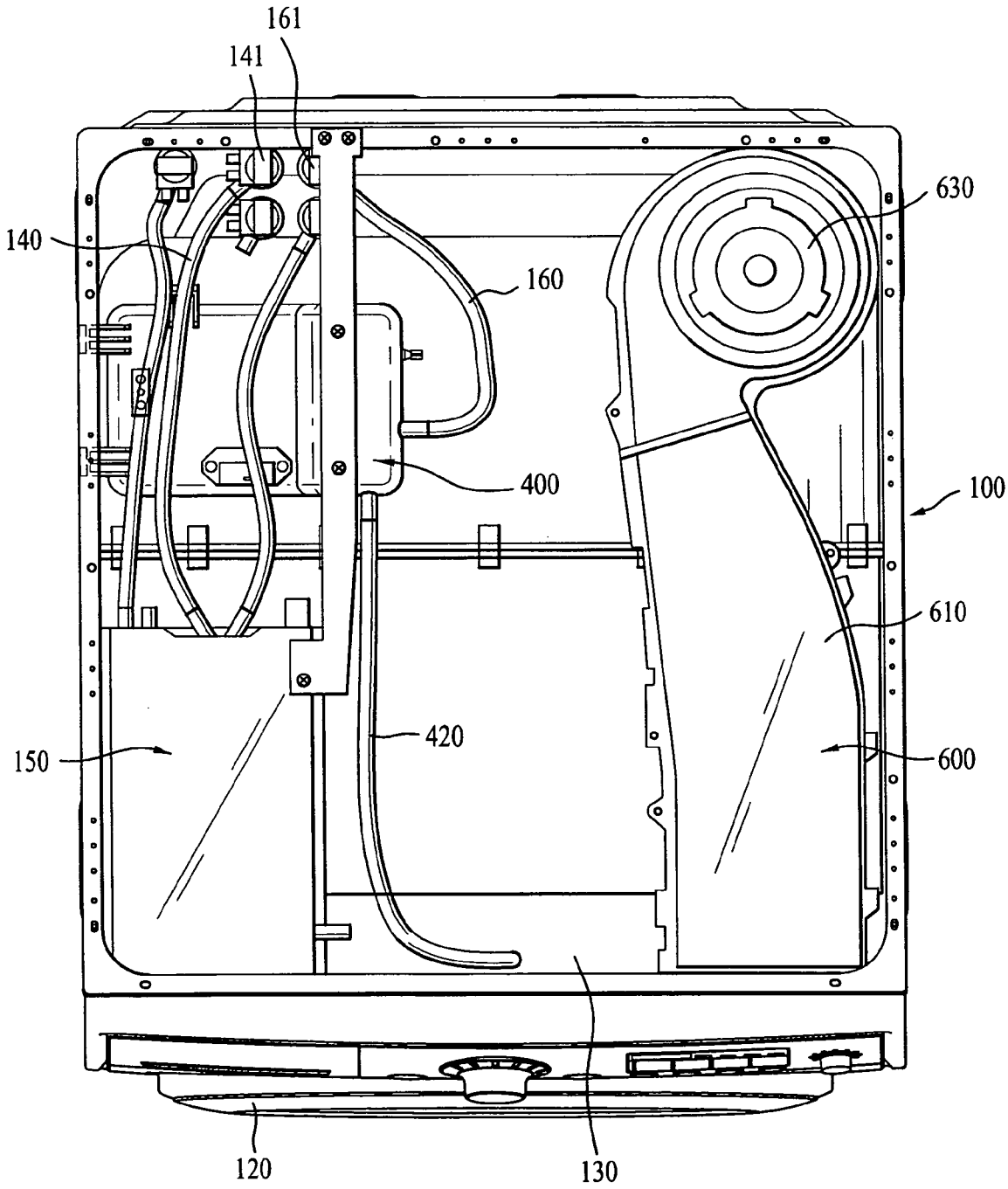
FIG. 2 is a plan view illustrating the internal structure of the washing machine of FIG. 1.

As shown in FIGS. 1 and 2, the washing machine in accordance with the preferred embodiment of the present invention comprises a main body 100, a tub 200, a drum 300, a steam supply unit 400, a temperature sensor 500, and an air supply unit 600.

The main body 100 forms the external appearance of the washing machine, and an opening 110, through which laundry, such as clothes, is put into the main body 100, is formed through the front surface of the main body 100.

A door 120 for opening and closing the opening 110 is installed on the main body 100 at a position close to the opening 110, and a rim portion 130 for hermetically sealing the inside of the opening 110 when the opening 110 is closed by the door 120 is installed along the internal circumferential surface of the opening 110.

A washing water supply pipe 140 for supplying washing water to the inside of the tub 200 is provided in the main body 100.

A detergent box 150 is provided in the main body 100, and the washing water supply pipe 140 is connected to the inside of the tub 200 via the detergent box 150.

The tub 200 is fixedly installed in the main body 100, and a washing water heater 210 for heating the washing water supplied to the inside of the tub 200 is provided at the lower end of the tub 200.

A drain channel 220 for draining the washing water to the outside of the tub 200 is connected to the lower end of the tub 200, and a drain pump 230 operated for forcibly draining the washing water is provided on the drain channel 220.

The drum 300 is rotatably installed in the tub 200 so that an opened surface of the drum 300 faces the opening 110 of the main body 100, thereby containing laundry to be washed. A driving unit 310 for rotating the drum 300 is connected to the lower surface of the drum 300.

In order to supply a designated amount of steam to the drum 300 (or the tub 200), at least one steam supply unit 400 is provided. FIG. 2 illustrates the installation of the steam supply unit 400 in detail.

The steam supply unit 400 comprises a steam generator 410 for heating water stored therein to generate steam, and a steam supply pipe 420 for guiding the flow of the generated steam.

Preferably, a steam outlet side of the steam supply pipe 420 passes through the rim portion 130 so that the steam outlet side faces the inside of the drum 300.

The temperature sensor 500 serves to sense the temperature of the inside of the tub 200.

Preferably, the temperature sensor 500 is provided in a space in the tub 200. The temperature sensed by the temperature sensor 500 is used to control the operations of the steam supply unit 400 and the air supply unit 600.

The air supply unit 600 is used to dry laundry, and supplies air, such as hot air or cold air, to the drum 300.

The air supply unit 600 comprises a drying duct 610, a drying heater 620, an air blast fan 630, and a fan motor (not shown).

Both ends of the drying duct 610 are connected to the inside of the tub 200. Preferably, one end of the drying duct 610 is connected to the rear part of the tub 200, and the other end of the drying duct 610 is connected to the front part of the tub 200. Otherwise, one end of the drying duct 610 may be connected to the inside of the tub 200, and the other end of the drying duct 610 may be connected to the outside of the main body 100.

The drying heater 620 is provided in the drying duct 610, and serves to heat air flowing in the drying duct 610.

The air blast fan 630 and the fan motor are provided in the drying duct 610, and serve to blow air in the drying duct 610 to the inside of the drum 300 via the drying heater 620.

Here, reference numeral 160 represents a steam water supply pipe for supplying tap water to the steam supply unit 400.

Further, reference numerals 141 and 161 are respectively switch valves for opening and closing the washing water supply pipe 140 and the steam water supply pipe 160.

Hereinafter, with reference to FIGS. 3 and 4, a method for operating the above washing machine in accordance with the preferred embodiment of the present invention will be described.

The method for operating the washing machine of the present invention is used in a refreshing operation, out of various operation of the washing machine, including washing and drying operation. The refreshing of laundry means to remove wrinkles or smells from the laundry using steam without using washing water. Accordingly, just after the refreshing of the laundry, such as clothes, is terminated, a user can wear the clothes without drying or ironing the clothes.

Figure 3:
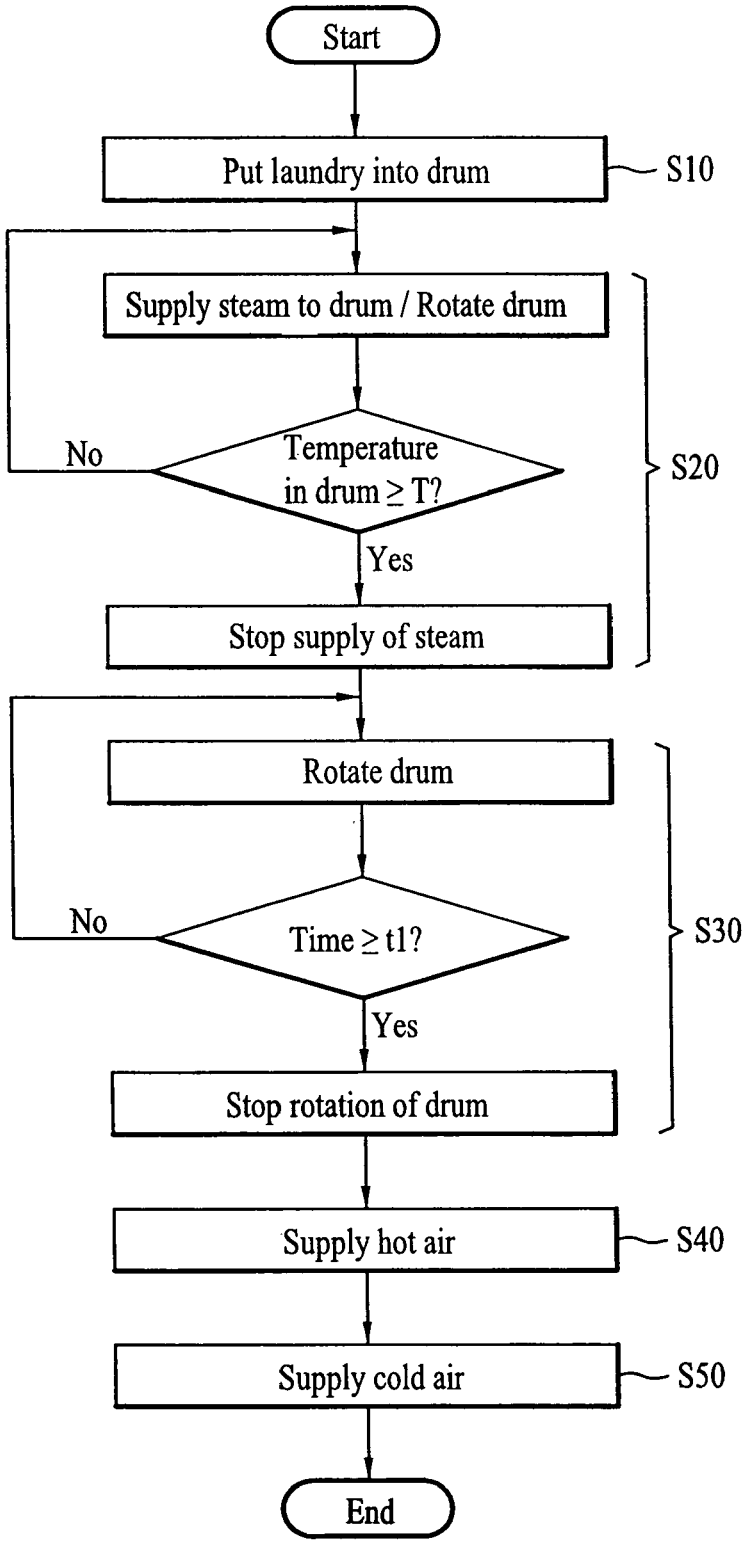
FIG. 3 is a flow chart for illustrating a method for operating a washing machine in accordance with one embodiment of the present invention.
Figure 4:
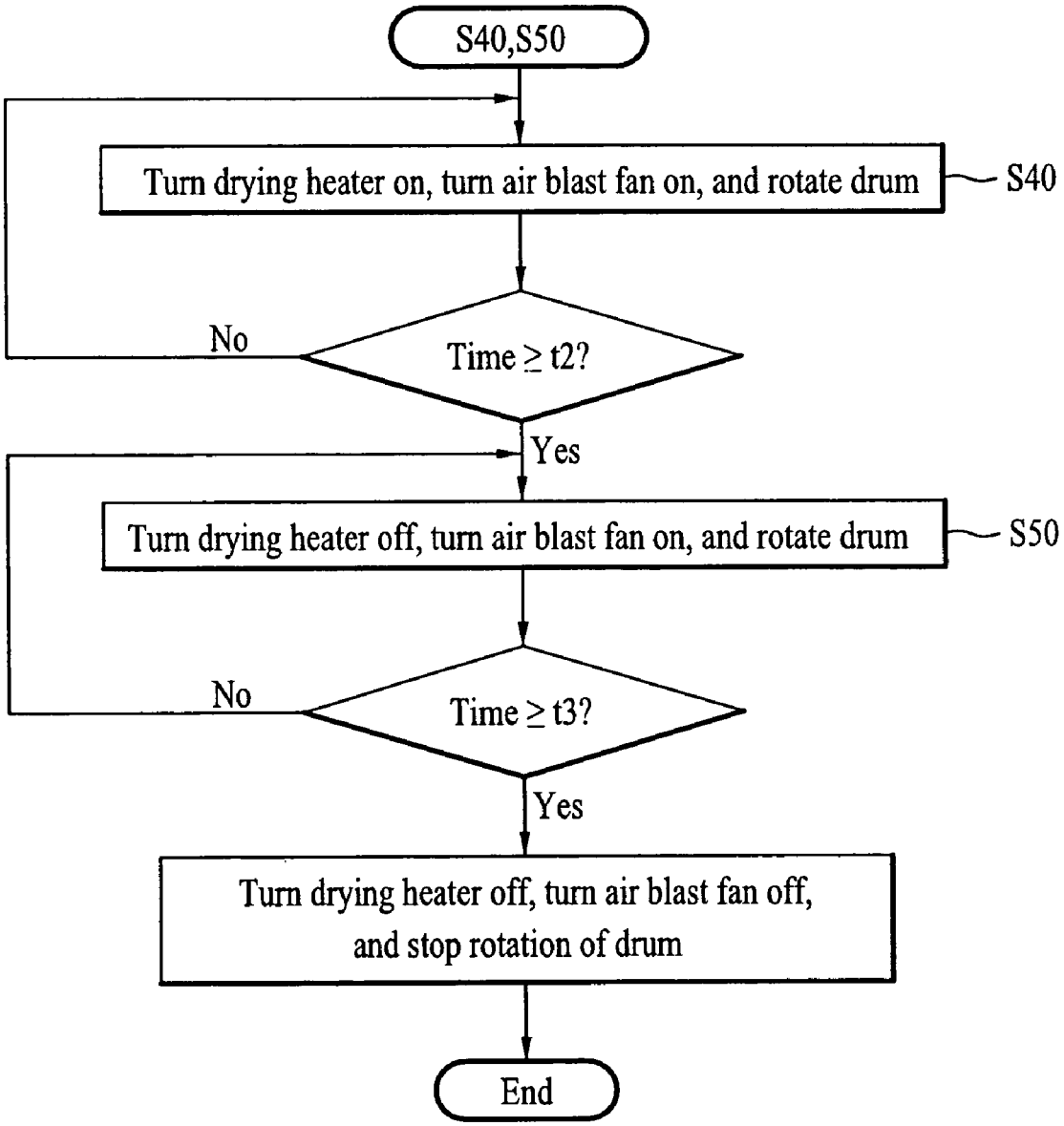
FIG. 4 is flow chart for illustrating the supply of hot air for performing a drying operation and the supply of cold air for performing a cooling operation in a refreshing process.

First, as shown in FIG. 3, laundry, such as clothes, to be refreshed is supplied to the drum of the washing machine (S10). When the refreshing operation is started, the laundry may be supplied to the drum. Otherwise, the refreshing operation may be started under the condition that the laundry is already in the drum.

Generally, the refreshing operation is applied to wrinkled laundry in a dried state. However, the refreshing operation may be applied to laundry containing a small amount of water after washing and dehydrating operations have been completed.

When the above supply of the laundry is completed, a controller (not shown) controls the steam supply unit 400 so that steam of a high temperature is supplied to the drum 300 (S20).

That is, water for generating steam is supplied to the steam generator 410, and then the steam generator 410 is heated so that the water is evaporated into steam. Then, the steam is supplied to the drum 300.

The steam allows clothes to contain a small amount of water. Thereby, the clothes are in a state, in which wrinkles are easily removed therefrom. Particularly, in consideration of a fact in that the steam is in a high-temperature state, it is possible to more easily remove wrinkles from the clothes. Further, the steam of a high temperature decomposes molecules of smells of laundry, thereby exhibiting a deodorizing effect.

The steam generated by the steam generator 410 is sprayed to the inside of the drum 300 through the steam supply pipe 420. Preferably, when the steam is supplied to the inside of the drum 300, the driving unit 310 rotates the drum 300 so that the steam is uniformly supplied to the clothes in the drum 300.

Preferably, the drum 300 is not rotated only in one direction, but is rotated in one direction and then in the reverse direction, thereby preventing the clothes in the drum 300 from being entangled and allowing the steam to be more uniformly supplied to the clothes in the drum 300.

The above-described supply of the steam to the inside of the drum 300 is continuously performed until the temperature in the drum 300 reaches a predetermined temperature.

The predetermined temperature is more than 40° C. The reason is that an atmosphere in the drum 300 at the temperature of more than 40° C. is the most effective to remove wrinkles and smells from the clothes in the drum 300.

The higher the temperature in the drum 300, the easier wrinkles are removed from the clothes in the drum 300. However, when the temperature in the drum 300 is excessively high, the clothes may be damaged or deformed and may excessively absorb the steam.

Accordingly, preferably, the predetermined temperature is in the range of 40~60° C., at which wrinkles and smells are removed from the clothes and the clothes are not damaged.

Further, the most optimum water content of the laundry contained in the drum 300 for refreshing the laundry is determined. Thus, when the amount of the laundry in the drum 300 is large, the amount of the steam supplied to the drum 300 is relatively large, and when the amount of the laundry in the drum 300 is small, the amount of the steam supplied to the drum 300 is relatively small. Accordingly, the amount and time of the steam supplied to the drum 300 are determined by the amount of the laundry contained in the drum 300.

Further, the amount of the steam varies according to the temperature in the drum 300. When the steam of a high temperature is continuously supplied to the drum 300, the supply amount of the steam is large and the temperature in the drum 300 is converged on the temperature of the supplied steam.

Accordingly, the supply of the steam to the drum 300 until the drum 300 reaches a relatively high temperature means that the supply amount of the steam is large, and finally means that the amount of the laundry contained in the drum 30 is large.

When the temperature in the drum 300 reaches the predetermined temperature, the steam supply unit 400 is controlled so that the supply of the steam is stopped.

Thereafter, the drum 300 is rotated for a designated time (t1) under the condition that the supply of the steam is stopped, thereby continuously removing wrinkles from the clothes (S30). Preferably, the designated time (t1) is set in direct proportion to the amount of the laundry supplied to the drum 300.

That is, when the amount of the laundry is large, the rotating time of the drum 300 is set to a relatively long time so that wrinkles and smells are sufficiently removed from the clothes, and when the amount of the laundry is small, the rotating time of the drum 300 is set to a relatively short time so that wrinkles and smells are satisfactorily removed from the clothes in a short period of time.

During the above rotating of the drum 300 after the supply of the steam to the drum 300, wrinkles are removed from the clothes in the drum 300, but the clothes contain moisture. Further, smell particles are still attached to the clothes, or smell particles floating the drum 300 or the tub 200 becomes reattached to the clothes.

Accordingly, after the rotating of the drum 300 (S30), in order to remove wrinkles from the clothes until the clothes reaches to a wearable state, to dry the clothes containing moisture due to the steam supply, and to firmly remove smells from the clothes, air is supplied to the drum 300 (S40 and S50).

In accordance with the preferred embodiment of the present invention, the supply of the air to the drum 300 (S40 and S50) is performed after the rotating of the drum 300 (S30). However, the supply of the air to the drum (S40 and S50) may be performed just after the supply of the steam (S20) without performing the rotating of the drum 300 (S30).

In this embodiment, the supply of the air (S40 and S50) comprises the supply of dry and hot air of a high temperature to the drum 300 to perform a drying operation (S40), and the supply of cold air of a low temperature to the drum 300 to perform a cooling operation (S50).

Hereinafter, with reference to FIG. 4, the supply of the hot air (S40) and the supply of the cold air (S50) will be described in more detail.

First, the drying heater 620 of the air supply unit 600 is operated. Thereby, the air in the drying duct 610 is heated to a high temperature. Simultaneously, the fan motor is operated, thus rotating the air blast fan 630. Thereby, the heated air in the drying duct 610 flows along the drying duct 610 and is blown to the inside of the tub 200. Accordingly, the heated air, i.e., hot air, which is blown to the inside of the tub 200, is supplied to the drum 300 for a designated time (t2).

Preferably, the drying heater 620 is turned on and off according to the temperature in the drum 300 sensed by the temperature sensor 500 so that the temperature in the drum 300 is maintained in a designated range. For example, during the supply of the hot air (S40), the drying heater 620 is turned on when the temperature in the drum 300 is less than a lower limit ($T_L$) and is turned off when the temperature in the drum 300 is more than an upper limit ($T_H$). Preferably, the temperature range (between $T_L$ and $T_H$) for controlling the drying heater 620 in this embodiment is lower than the temperature range for controlling a drying heater during the conventional supply of hot air in a washing machine (for example, during a drying operation after washing and dehydrating operations of a drum washing machine). Since the amount of moisture contained in the laundry from which wrinkles need to be removed is smaller than the amount of moisture contained in laundry to be dried in the conventional drying operation, when hot air of an excessively high temperature is supplied to the laundry from which wrinkles need to be removed, the laundry may be damaged.

During the above supply of the hot air (S40), in order to uniformly supply the hot air to the clothes contained in the drum 300, the drum 300 is preferably rotated. Here, in order to prevent the clothes from being entangled and to more uniformly supply the hot air to the laundry, the drum 300 is more preferably rotated in regular and reverse directions alternately. Further, the drum 300 may be repeatedly rotated and stopped in a designated cycle.

Preferably, the designated time (t2) to perform the supply of the hot air varies in proportion to the amount of the clothes supplied to the drum 300. That is, when the amount of the clothes is small, the time (t2) is set to approximately 10 minutes, and when the amount of the clothes is large, the designated time (t2) is set to 20 approximately 20 minutes.

Preferably, the above time (t2) is set before a refreshing operation is started, i.e., before the steam is supplied to the drum 300.

When the hot air of a high temperature is supplied to the drum 300, as described above, moisture contained in the clothes is evaporated so that the clothes is returned to a dried state.

Since the inside of the drum 300 reaches a considerably high temperature during the supply of the hot air (S40), it is dangerous to take the clothes out of the drum 300 and the clothes is not wearable just after the supply of the hot air (S40).

Accordingly, when the time (t2) of the supply of the hot air (S40) has elapsed, the drying heater 620 is turned off, and the air blast fan 630 is continuously operated so that the supply of cold air of a lower temperature to the inside of the drum 300 (S50) is performed for a designated time (t3).

Of course, it is possible to naturally lower the temperature in the drum 300 by continuously rotating the drum 300 after the supply of the hot air (S40). However, in order to increase the reliability of the washing machine, it is preferable that the supply of the cold air (S50) is performed after the supply of the hot air (S40).

In accordance with this embodiment of the present invention, the supply of the cold air (S50) is performed for the designated time (t3), as described above. However, the supply of the cold air (S50) may be performed until the temperature in the drum 300 is lowered less than a designated temperature.

More preferably, the drum 300 is rotated during the supply of the cold air (S50) so that the temperature in the drum 300 is more effectively lowered.

The above supply of the hot and cold air (S40 and S50) dries and cools the laundry, and allows smell particles, which are attached to the laundry or exist in the drum, to be discharged to the outside, thereby more effectively deodorizing the laundry.

In the above-described embodiment, a process for condensing moisture in air when the air is circulated through the drying duct 610 during the supply of the hot air (S40) and the supply of the cold air (S50) is not performed.

However, condensing water may be supplied to the inside of the drying duct 610 through a condensing water supply pipe 650 during the supply of the hot air (S40) and the supply of the cold air (S50). The condensing water removes moisture from the air circulated through the drying duct 610, thereby increasing a drying capacity.

In this case, preferably, the drain pump 230 is periodically operated so that the condensing water collected on the lower portion of the drying duct 610 is discharged to the outside.

When the designated time (t3) of the supply of the cold air (S50) has elapsed or the temperature in the drum 300 is less than a predetermined temperature, the rotation of the drum 300 is stopped and the rotation of the air blast fan 630 is stopped. Thereby, the refreshing operation is terminated.

Now, with reference to FIG. 5, a washing machine and a method for operating the same in accordance with another embodiment of the present invention will be described in detail.

The washing machine of this embodiment has the same configuration as that of the washing machine of the former embodiment, but the method of this embodiment differs from the method of the former embodiment in that the supply of steam and the supply of air are simultaneously performed in the method of this embodiment.

Hereinafter, with reference to FIG. 5, the method for operating the washing machine to remove wrinkles from laundry in accordance with this embodiment is described in detail.

First, laundry to be refreshed is supplied to the drum of the washing machine (S110). Preferably, the drum is rotated identically with the method of the earlier embodiment.

Thereafter, the supply of steam to the drum is substantially performed simultaneously with the supply of air to the drum. FIG. 5 illustrates the supply of the steam and the supply of the air, which are simultaneously performed, (S120).

Here, the supply of the air is periodically or intermittently performed.

In the supply of the air, the supplied air is hot air or cold air. The supply of the air is performed simultaneously with the supply of the steam, thereby rapidly and uniformly supplying the steam to the laundry.

Further, it is possible to shorten a time to perform the refreshing operation. That is, since a steam supply time is shortened and a time to perform a drying or cooling operation is shortened, it is possible to shorten the time to perform the refreshing operation of the washing machine.

Thereafter, after the supply of the steam and the supply of the air are stopped (S130), the drum is continuously rotated for a designated time (S140).

Figure 5:
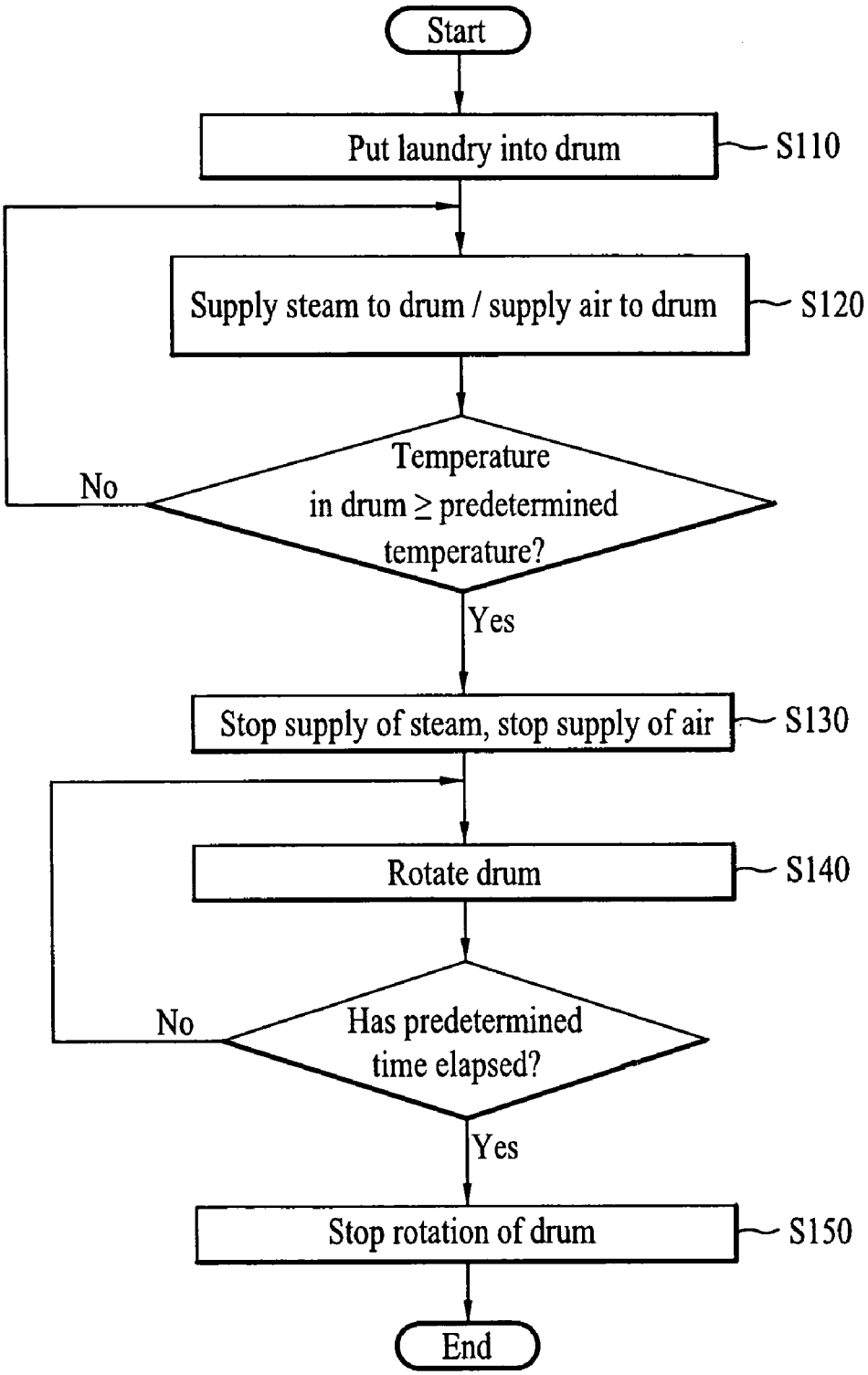
FIG. 5 is a flow chart for illustrating a method for operating a washing machine in accordance with another embodiment of the present invention.

Although not shown in FIG. 5, after the rotation of the drum is terminated, the supply of hot air and the supply of cold air, as shown in FIG. 3, may be performed.

During the supply of the air, when cold air is supplied to the drum, a time to remove moisture from laundry is longer than that when hot air is supplied to the drum, but a time to lower the temperature of the laundry is shortened or not required.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

Industrial applicability of the present invention is described above.

What is claimed is:

1. A method for performing a refreshing operation of a washing machine or a drying machine to remove wrinkles or smells from laundry using steam without using washing water, which includes a steam generator for heating water to generate steam and a drying heater, separately provided in a drying duct, to heat air flowing in the drying duct, comprising:

generating and supplying steam to a drum containing laundry to allow the laundry to contain a small amount of water, wherein a water inlet of the steam generator is connected with a switch valve through a steam water supply pipe so as to receive water only from the switch valve and to generate steam in the steam generator and wherein the steam generator is provided separately from the drying heater;

supplying air to the drum after supplying the steam, wherein the supply of the air comprises supplying hot air to the drum to remove moisture from the laundry; and rotating the drum for a predetermined time after the supply of the steam is terminated and before the supply of the air is started, thereby continuously removing wrinkles from the laundry.

2. The method as set forth in claim 1, wherein the drum is rotated during the supply of the steam.

3. The method as set forth in claim 1, wherein the supply of the steam is performed until the temperature in the drum reaches a predetermined temperature.

4. The method as set forth in claim 3, wherein the predetermined temperature is in the range of 40~60° C.

5. The method as set forth in claim 3, wherein the predetermined temperature is determined by the amount of the laundry contained in the drum.

6. The method as set forth in claim 1, wherein the drum is rotated during the supply of the air.

7. The method as set forth in claim 1, wherein the supply of the air is performed for a predetermined time.

8. The method as set forth in claim 7, wherein the predetermined time is determined by the amount of the laundry contained in the drum.

9. The method as set forth in claim 1, wherein the supply of the air further comprises supplying cold air to the drum to remove moisture from the laundry and to cool the laundry, simultaneously.

10. The method as set forth in claim 9, wherein the supply of the cold air is performed until the temperature in the drum is less than a predetermined temperature.

11. The method as set forth in claim 10, wherein the drum is rotated during the supply of the cold air.

12. A method for performing a refreshing operation of a washing machine or a drying machine to remove wrinkles or smells from laundry using steam without using washing water, which includes a steam generator for heating water, the water being supplied and stored in the steam generator and then heated to generate steam, and a drying heater provided in a drying duct to heat air flowing in the drying duct, comprising:

generating and supplying steam to a drum containing laundry, wherein a water inlet of the steam generator is connected with a switch valve through a steam water supply pipe so as to only receive water from the switch valve to generate steam in the steam generator and the steam generator is provided separately with the drying heater;

supplying air to the drum after supplying the steam, wherein the supply of the air comprises supplying hot air to the drum to remove moisture from the laundry; and rotating the drum for a predetermined time after the supply of the steam is terminated and before the supply of the air is started, thereby continuously removing wrinkles from the laundry, wherein the amount and time of the steam supplied to the drum is determined by the amount of the laundry contained in the drum.

13. The method as set forth in claim 12, wherein a condensing process for condensing air discharged from the drum is performed during the supply of the hot air.

14. The method as set forth in claim 13, wherein a drain pump is operated during the supply of the hot air to discharge condensed water generated from the condensing process.

15. The method as set forth in claim 12, wherein the supply of the air further comprises supplying cold air, after the supply of the hot air, to cool the laundry.

16. The method as set forth in claim 15, wherein the supply of the cold air is performed until the temperature in the drum is less than a predetermined temperature, or is performed for a predetermined time.

17. The method as set forth in claim 12, wherein the supply of the air is periodically or intermittently performed.

* * * * *